US007540927B2

(12) United States Patent
Chiba

(10) Patent No.: US 7,540,927 B2
(45) Date of Patent: Jun. 2, 2009

(54) SOFT MAGNETIC STEELS EXCELLENT IN COLD FORGEABILITY, MACHINABILITY AND MAGNETIC PROPERTIES, AND SOFT MAGNETIC STEEL PARTS EXCELLENT IN MAGNETIC PROPERTIES

(75) Inventor: Masamichi Chiba, Kobe (JP)

(73) Assignee: Kobe Steel, Ltd., Kobe-shi (JP)

( * ) Notice: Subject to any disclaimer, the term of this patent is extended or adjusted under 35 U.S.C. 154(b) by 210 days.

(21) Appl. No.: 11/456,400

(22) Filed: Jul. 10, 2006

(65) Prior Publication Data

US 2007/0034300 A1 Feb. 15, 2007

(30) Foreign Application Priority Data

Aug. 11, 2005 (JP) ..... 2005-233019

(51) Int. Cl.
*H01F 1/147* (2006.01)

(52) U.S. Cl. ..... 148/311; 148/306; 148/307; 148/310; 420/87; 420/91; 420/92

(58) Field of Classification Search ..... None
See application file for complete search history.

(56) References Cited

U.S. PATENT DOCUMENTS 6,635,361 B1 * 10/2003 Sugihara et al. ..... 428/667
7,267,729 B2 * 9/2007 Chiba et al. ..... 148/306
2004/0007290 A1 * 1/2004 Sugihara et al. ..... 148/120
2004/0149355 A1 * 8/2004 Kohno et al. ..... 148/111
2005/0139289 A1 6/2005 Chiba et al.

FOREIGN PATENT DOCUMENTS

JP 7-90505 * 4/1995
JP 2000-8146 1/2000
JP 2000-30922 1/2000
JP 2003-55745 2/2003

OTHER PUBLICATIONS

U.S. Appl. No. 11/456,400, filed Jul. 10, 2006, Chiba.

* cited by examiner

*Primary Examiner*—John P. Sheehan
(74) *Attorney, Agent, or Firm*—Oblon, Spivak, McClelland, Maier & Neustadt, P.C.

(57) ABSTRACT

A soft magnetic steel has, on the mass basis, a carbon content of 0.0015% to 0.02%, a manganese content of 0.15% to 0.5%, and a sulfur content of 0.015% to 0.1%, has a ratio Mn/S of 5.7 or more, and contains a single-phase ferrite microstructure as its metallographic structure, in which the density of precipitated FeS grains having a major axis of 0.1 μm or more is 5000 grains/mm$^2$ or less. This steel ensures excellent magnetic properties with less variation after magnetic annealing, exhibits excellent machinability and cold forgeability during production processes, and can thereby yield a steel part even having a complicated shape and a large size in a high yield.

6 Claims, 6 Drawing Sheets

SOFT MAGNETIC STEELS EXCELLENT IN COLD FORGEABILITY, MACHINABILITY AND MAGNETIC PROPERTIES, AND SOFT MAGNETIC STEEL PARTS EXCELLENT IN MAGNETIC PROPERTIES

BACKGROUND OF THE INVENTION

1. Field of the Invention

The present invention relates to a soft magnetic steel part useful for forming iron cores for solenoids, relays and solenoid valves to be applied to various electric devices typically for automobiles, electric trains and ships, and a soft magnetic steel as a material for the soft magnetic steel part. More particularly, it relates to a soft magnetic steel that can yield a steel part with excellent dimensional accuracy in a high yield by shape forming (hereinafter this property is also simply referred to as "cold forgeability"), exhibits satisfactory machinability in production of the part by machining, and ensures excellent magnetic properties meeting requirements specified in Japanese Industrial Standards (JIS) SUYB Class 1 or higher as a result of magnetic annealing. It also relates to a soft magnetic steel part that is made from the steel and has excellent magnetic properties meeting requirements specified in JIS SUYB Class 1 or higher.

"SUYB" herein represents a standard of magnetic properties specified in JIS C 2503. The electric devices require magnetic properties approximately at such a level meeting requirements specified in JIS SUYB Class 1.

2. Description of the Related Art

Magnetic circuits included in electric devices typically for automobiles are required to be more precisely controlled for the improvement of power consumption and magnetic responsibility of the electric circuits, responding to the purpose of energy savings, typically in automobiles. The material steels for the electric devices are required to have a low coercive force, in addition to a capability of being easily magnetized by a low-intensity external magnetic field.

Thus, those electric devices are generally formed of soft magnetic steels so that the magnetic flux density in the electric devices changes in quick response to the change of an external magnetic field. Representative soft magnetic steels are very-low-carbon steels having a carbon (C) content on the order of 0.01 percent by mass or less (a soft magnetic pure-iron-based material). An electric device (a soft magnetic steel part) is generally manufactured by subjecting a steel billet of a very-low-carbon steel to hot rolling, subjecting the resulting steel sheet typically to lubrication and drawing to yield a steel wire, and sequentially subjecting the steel wire to forming work (cold forging) and magnetic annealing.

Electric devices using electromagnetic force have conventionally chiefly used as switches typically for hydraulic control in various fields such as the auto industry field. However, a control system of directly driving mechanisms by the action of electromagnetic force is now increasingly employed for power saving and higher performance. Electric devices having this control system require higher electromagnetic driving force than conventional electric devices, to which a magnetic field at a high intensity of 5000 A/m or more is applied. Accordingly, a soft magnetic steel part that stably exhibits excellent magnetic properties even in magnetic fields at such high intensities, and a soft magnetic steel as a material for the soft magnetic steel part have been demanded.

The dimensions of, for example, iron cores of such electromagnetic parts have become increased in size and complicated more and more. In this connection, iron cores requiring excellent magnetic properties must not only have excellent magnetic properties of their materials but also undergo finish machining with high precision, because trace variations in dimensions of produced parts significantly adversely affect the magnetic properties of the final products. Avery-low-carbon steel (soft magnetic pure-iron-based material) is flexible and resistant to cutting. Consequently, the productivity markedly decreases when a very-low-carbon steel part with high dimensional accuracy is to be manufactured by machining.

A possible solution to improve the machinability of soft magnetic pure-iron-based materials can be found in, for example, Japanese Unexamined Patent Application Publication (JP-A) No. 2003-055745. This technique is intended to minimize the reduction in magnetic properties due to elements that impart free-machinability and to inhibit burrs during machining to thereby improve the productivity, by controlling the distribution and dimensions of MnS grains in the steel within proper ranges. However, the technique is still susceptible to improvement in variation of properties when the steel is manufactured in a continuous annealing system.

Techniques for reducing the influence of eddy current in very-low-carbon steels can be found in JP-A No. 2000-8146 and JP-A No. 2000-30922. These techniques are mainly intended to reduce eddy-current loss in an alternating magnetic field by controlling the dispersion of sulfides in steels, but they fail to consider steels for use in applications requiring excellent magnetic properties in a high-intensity magnetic field, as in electromagnetic solenoids.

SUMMARY OF THE INVENTION

Under these circumstances, an object of the present invention is to provide a soft magnetic steel that ensures excellent magnetic properties without variation after magnetic annealing, enables tools used in machining to have a longer lifetime even when used for the manufacture of steel parts having large sizes and complicated dimensions, and forms a soft magnetic part having excellent dimensional accuracy in a high yield. Another object of the present invention is to provide a soft magnetic steel part that is prepared from the soft magnetic steel through magnetic annealing and exhibits excellent magnetic properties meeting requirements specified in JIS SUYB Class 1 or higher even in a high-intensity magnetic field.

Specifically, the present invention provides a soft magnetic steel having a composition satisfying:

a carbon (C) content of 0.0015 to 0.02 percent by mass;

a manganese (Mn) content of 0.15 to 0.5 percent by mass; and a sulfur (S) content of 0.015 to 0.1 percent by mass, in which the steel has a mass ratio of Mn to S (Mn/S) of 5.7 or more, the steel contains a single-phase ferrite microstructure as its metallographic structure, and the density of precipitated FeS grains having a major axis of 0.1 μm or more is 5000 grains or less per square millimeter of the steel.

In the soft magnetic steel, the density of precipitated MnS grains having a major axis exceeding 5 μm is preferably 5 grains or less and the number of precipitated MnS grains having a major axis of 0.5 to 5 μm is preferably 20 to 80 grains, each per 10000 square micrometers of a section in a rolling direction of the steel.

The soft magnetic steel can have a composition further satisfying:

a silicon (Si) content of 0.05 percent by mass or less (exclusive of 0 percent by mass);

an aluminum (Al) content of 0.01 percent by mass or less (exclusive of 0 percent by mass);

a phosphorus (P) content of 0.02 percent by mass or less (exclusive of 0 percent by mass);

a nitrogen (N) content of 0.01 percent by mass or less (exclusive of 0 percent by mass); and an oxygen (O) content of 0.01 percent by mass or less (exclusive of 0 percent by mass).

The soft magnetic steel according to the present invention can have a composition further satisfying at least one selected from the group consisting of:

a copper (Cu) content of 0.02 to 0.2 percent by mass;

a nickel (Ni) content of 0.02 to 0.2 percent by mass; and a chromium (Cr) content of 0.02 to 0.2 percent by mass.

For further satisfactory cold forgeability, the soft magnetic steel preferably satisfy the following Condition (1):

$$Mn/S+56.8C \geqq 5.3 \quad (1)$$

wherein "Mn", "S", and "C" represent the contents (percent by mass) of manganese, sulfur, and carbon, respectively.

In addition, the present invention provides a soft magnetic steel part made from the steel, wherein the part has a single-phase ferrite microstructure having an average grain size of 100 μm or more as its metallographic structure. This soft magnetic steel part is excellent in magnetic properties.

The density (number of grains per specific area) of precipitated FeS grains having a major axis of 0.1 μm or more is the density as determined by an electron microscopic observation at a magnification of 4000 times. The density of precipitated MnS grains having a major axis exceeding 5 μm and the density of precipitated MnS grains having a major axis of 0.5 to 5 μm are the numbers of grains, each per 10000 square micrometers of a section in a rolling direction of the steel, determined by electron microscopic observation at a magnification of 2400 times.

The soft magnetic steels according to the present invention ensure excellent magnetic properties without variation after magnetic annealing, have excellent cold forgeability upon forming work, are excellent in machinability and thereby prolong the lifetime of tools used in machining. These steels are subjected to forming work, and the formed parts are subjected to magnetic annealing to thereby yield soft magnetic steel parts that exhibit excellent magnetic properties meeting requirements specified in JIS SUYB Class 1 or higher without variation. The soft magnetic steel parts can produce electric devices exhibiting excellent magnetic properties stably with good productivity at low cost. These electric devices can satisfactorily be used in automobiles, electric trains, and ships.

Further objects, features and advantages of the present invention will become apparent from the following description of the preferred embodiments with reference to the attached drawings.

DESCRIPTION OF THE PREFERRED EMBODIMENTS

The present inventors made intensive investigations on influence of the metallographic structure (in particular precipitates therein) and chemical composition on magnetic properties, cold forgeability, and machinability of soft magnetic pure-iron-based steels so as to improve these properties concurrently. As a result, they have found that reduction of the density of precipitated FeS grains markedly reduces the variation in magnetic properties and improves the cold forgeability.

Figure 1:
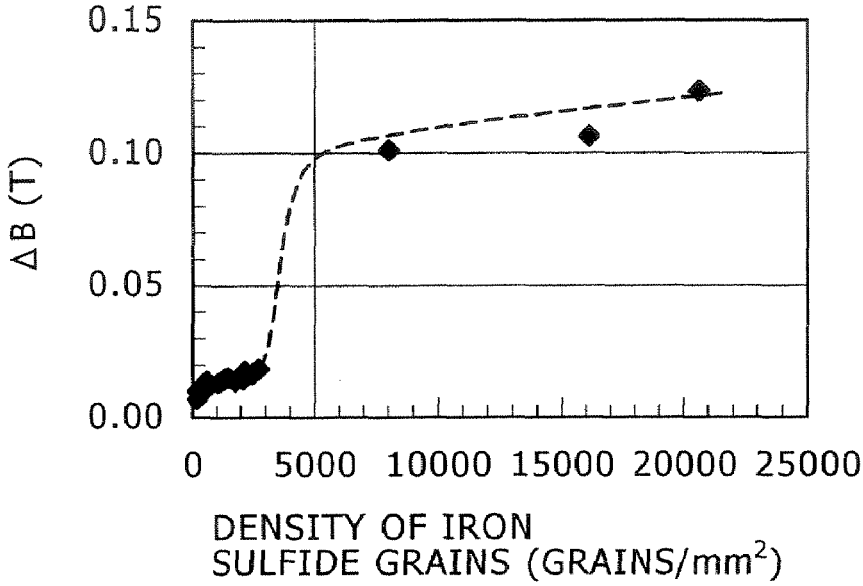
FIG. 1 is a graph showing the relationship between the density of precipitated FeS grains and ΔB.

FIG. 1 is a graph showing the relationship between the density of precipitated FeS grains and ΔB, as determined by the method described in after-mentioned Examples. ΔB represents the variation in the magnetic flux density at a magnetic field intensity of 40,000 A/m. FIG. 1 demonstrates that the variation ΔB markedly decreases to the vicinity of zero by controlling the density of precipitated FeS grains to 5000 grains/mm$^2$ or less.

Although reasons therefor have not yet been clarified, this tendency is probably because FeS grains are locally precipitated in a large amount to increase the wall pinning energy and to impair the magnetic properties to thereby significantly increase ΔB if the density of precipitated FeS grains exceeds 5000 grains/mm$^2$.

Based on the data in FIG. 1, the density of precipitated FeS grains should be controlled preferably to 3000 grains/mm$^2$ or less, more preferably to 1000 grains/mm$^2$ or less, and most preferably to zero, for further reducing the variation (ΔB).

Figure 2:
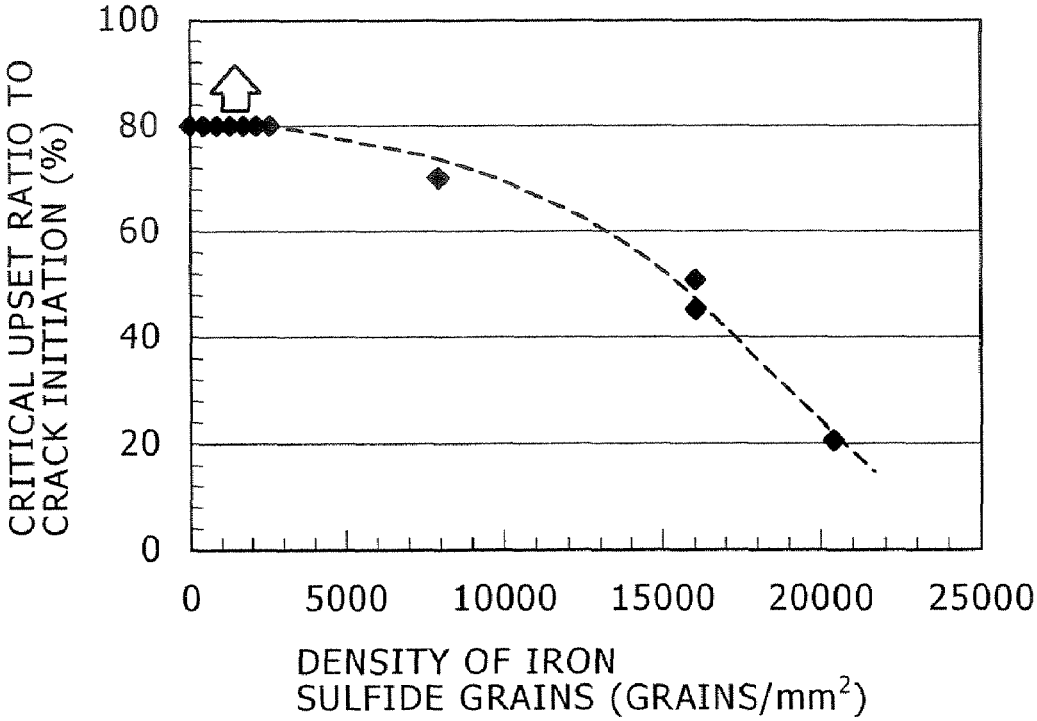
FIG. 2 is a graph showing the relationship between the density of precipitated FeS grains and the critical upset ratio to crack initiation.

FIG. 2 is a graph showing the relationship between the density of precipitated FeS grains and the critical upset ratio to crack initiation, as determined by the method described in after-mentioned Examples. FIG. 2 demonstrates that a high critical upset ratio to crack initiation, i.e., excellent cold forgeability can also be ensured by controlling the density of precipitated FeS grains to 5000 grains/mm$^2$ or less.

The reduction in productivity due to the precipitation of FeS grains can be effectively prevented by setting the final temperature of the continuous casting at 700° C. or lower, and setting the temperature of finishing rolling in hot rolling at 950° C. or higher in the production process.

Figure 3:
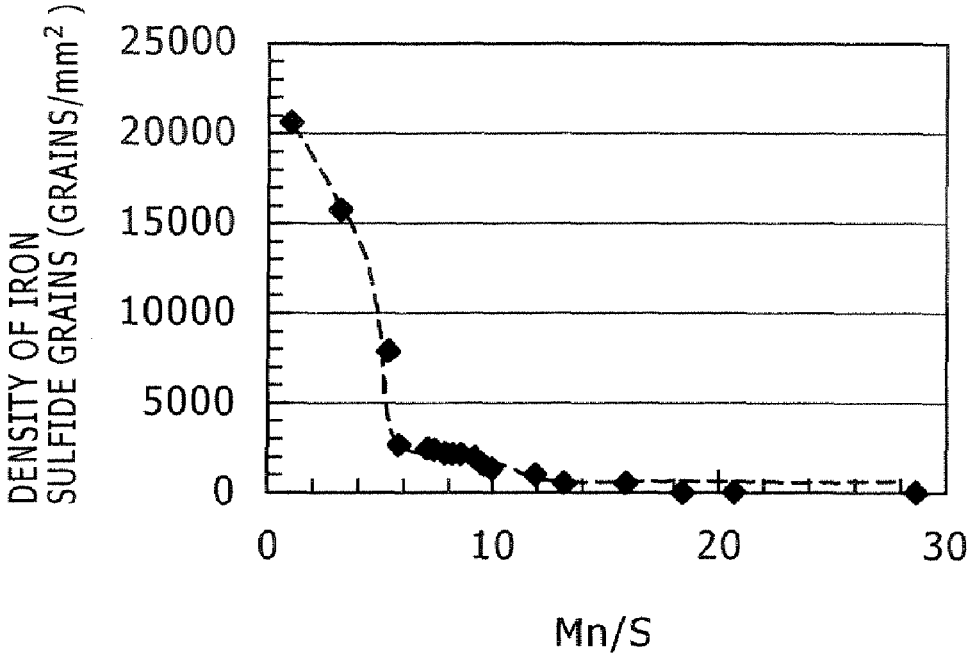
FIG. 3 is a graph showing the relationship between the ratio of Mn to S (Mn/S) and the density of precipitated FeS grains.

In addition to satisfying the above requirements in production, the ratio Mn/S is preferably controlled to there by further reliably reduce the density of precipitated FeS grains. FIG. 3 shows the relationship between the ratio Mn/S and the density of precipitated FeS grains, as determined by manufacturing steels having different Mn/S ratios under the above-mentioned conditions and measuring the density of precipitated FeS grains in the steels. FIG. 3 shows that the density of precipitated FeS grains can be reliably controlled to 5000 grains/mm$^2$ or less by setting the ratio Mn/S at 5.7 or more.

Figure 4:
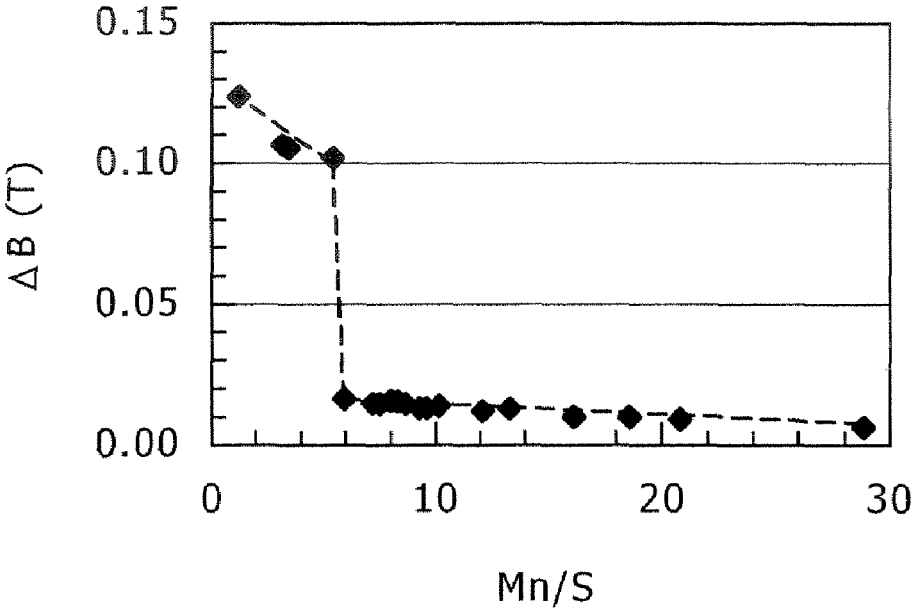
FIG. 4 is a graph showing the relationship between Mn/S and ΔB.

FIG. 4 shows the relationship between Mn/S and ΔB, as determined by measuring ΔB of the above-manufactured steels having different Mn/S ratios according to the methods described in Examples. FIG. 4 demonstrates that ΔB can be markedly reduced by setting the ratio Mn/S at 5.7 or more provided that the steels are manufactured under the above-specified conditions. Specifically, FIGS. 3 and 4 demonstrate that the variation ΔB can be significantly reduced by adjusting the manufacturing process conditions and the chemical composition of steels to thereby reduce the density of precipitated FeS grains.

The present inventors have further found that machinability typified by abrasion loss of cutting tools in machining can be significantly improved and the cold forgeability can be increased while ensuring excellent magnetic properties with less variation, by controlling the density of precipitated MnS grains according to the sizes of the grains.

When the C content is reduced so as to yield good magnetic properties, the cutting force markedly increases, and cutting cannot be significantly conducted with good precision, as is described above. In addition, the abrasion loss of tools increases, and the lifetime of cutting tools is often shortened. The present inventors, however, have found that the cutting force can be reduced and good machinability can be ensured by allowing the sulfide (MnS) having a major axis of 0.5 to 5 μm to precipitate in a density of 20 grains/10000 $\mu m^2$ or more. For further improving the machinability, the density of precipitated MnS grains having a major axis of 0.5 to 5 μis more preferably set at 50 grains/10000 $\mu m^2$ or more.

In contrast, if the steel contains the precipitated grains in an excessively high density, the grain growth upon magnetic annealing is inhibited so as to yield a lot of grain boundaries, and this acts as a resistance upon movement of the magnetic domain walls. Thus, the "responsibility to an external magnetic field" (magnetic responsibility), one of magnetic properties, is impaired. In addition, the precipitated grains themselves act to bind the magnetic domain walls to thereby decrease the magnetic responsibility. Furthermore, excessive precipitated MnS grains may often cause cracking during cold forging and thereby markedly reduce the productivity. Accordingly, the density of the precipitated MnS grains having a major axis of 0.5 to 5 μm is preferably 80 grains/10000 $\mu m^2$ or less, and more preferably 60 grains/10000 $\mu m^2$ or less so as to ensure excellent magnetic properties and excellent cold forgeability.

Coarse precipitated MnS grains having a major axis exceeding 5 μm, if contained, act to bind the magnetic domain walls to markedly impair the magnetic properties and cause cracking during cold forging. The density of such coarse MnS grains having a major axis exceeding 5 μm is therefore preferably controlled to 5 grains/10000 $\mu m^2$ or less and more preferably to 2 grains/10000 $\mu m^2$ or less.

The precipitated MnS grains herein mean and include sulfide MnS grains alone, as well as multicomponent precipitated grains of the sulfide with an oxide such as MnO, Mgo, or $Al_2O_3$, and multicomponent precipitated grains of the sulfide with a nitride.

To ensure excellent magnetic properties, the steels according to the present invention should have a single-phase ferrite microstructure as their metallographic structure, and the product steel parts obtained from the steels should have an average grain size of the ferrite of 100 μm or more. The magnetic properties of such soft magnetic steels are in relation with the energy quantity for fixing flux traveling within the material and are affected by the sizes of ferrite grains, the magnetic properties of precipitated grains, and distribution of precipitated grains. By increasing the average grain size of ferrite grains so as to reduce the grain boundary area, the coercive force can be reduced and the magnetic flux density can be increased. This ensures magnetic properties suitable for constitutional members of electric devices, such as iron cores of solenoids, relays, and electromagnetic valves. The ferrite grains preferably have an average grain size of 200 μm or more.

The term "single-phase ferrite microstructure" used herein includes a ferrite microstructure including not only ferrite grains but also the precipitated FeS grains, precipitated MnS grains, and other precipitated grains inevitably formed during manufacturing process. It is effective to minimize the C content for the formation of such a single-phase ferrite microstructure.

As is described above, one of features of the present invention is control of the densities of precipitated grains typified by precipitated FeS grains within appropriate ranges. In addition, steels for use in the present invention preferably have a chemical composition satisfying the following conditions, for efficiently controlling the size and density of precipitates and for ensuring properties such as magnetic properties and strength as required in electric devices.

Carbon (C) Content: 0.0015 to 0.02 Percent by Mass

Carbon (C) is an essential element that dominates the mechanical strength of steels. Carbon in a small amount acts to increase the electrical resistance to thereby avoid the deterioration of magnetic properties due to eddy current. However, the magnetic properties in a high-intensity magnetic field may be significantly impaired with an increasing C content, because carbon is dissolved in steels to there by deform the crystal lattice of iron. The C content is preferably minimized also from the viewpoint of other magnetic properties. It is preferably 0.02 percent by mass or less and more preferably 0.01 percent by mass or less, for ensuring magnetic properties meeting requirements specified in JIS SUYB Class 1 or higher. The lower limit of the C content is set at 0.0015 percent by mass, because the effects of reduction in C content become saturated at a C content less than 0.0015 percent by mass.

In addition to the control of the C content within the above-specified range, the relationship between the C content and Mn/S is preferably controlled so as to satisfy following Condition (1). This inhibits cracking during hot working, and the cold forging in a subsequent step can be satisfactorily carried out.

Figure 5:
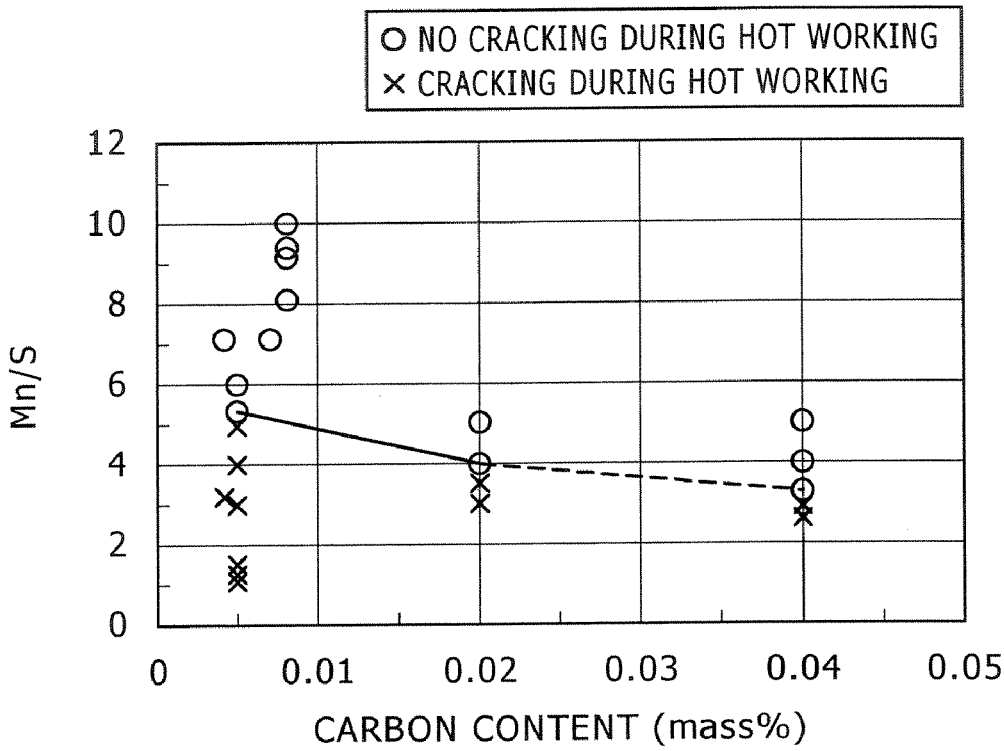
FIG. 5 is a graph showing the relationship between the C content and Mn/S.

FIG. 5 is a graph showing the relationship among the cracking during hot working, the C content, and the ratio Mn/S. FIG. 5 shows that the C content and Mn/S preferably satisfy following Condition (1) which is indicated by the region on or above the solid line in FIG. 5. By satisfying this, cracking during hot working can be reliably prevented.

$$Mn/S+56.8C \geqq 5.3 \quad (1)$$

Manganese (Mn) Content: 0.15 to 0.5 Percent by Mass

Manganese (Mn) functions as an effective deoxidizer, and combines with sulfur (S) contained in steels to prevent hot embrittlement caused by sulfur. If sulfur in steels combines with iron and precipitates as FeS at grain boundaries, the variation of magnetic properties increases and the hot ductility decreases, namely, the formability is impaired. Manganese also serves to avoid these problems by combining with sulfur. The precipitated MnS grains serve as a chip breaker upon machining, improves chip treatability, and reduces abrasion loss of cutting tools. Thus, the present invention sets the manganese content at 0.15 percent by mass or more, and preferably 0.20 percent by mass or more.

Figure 6:
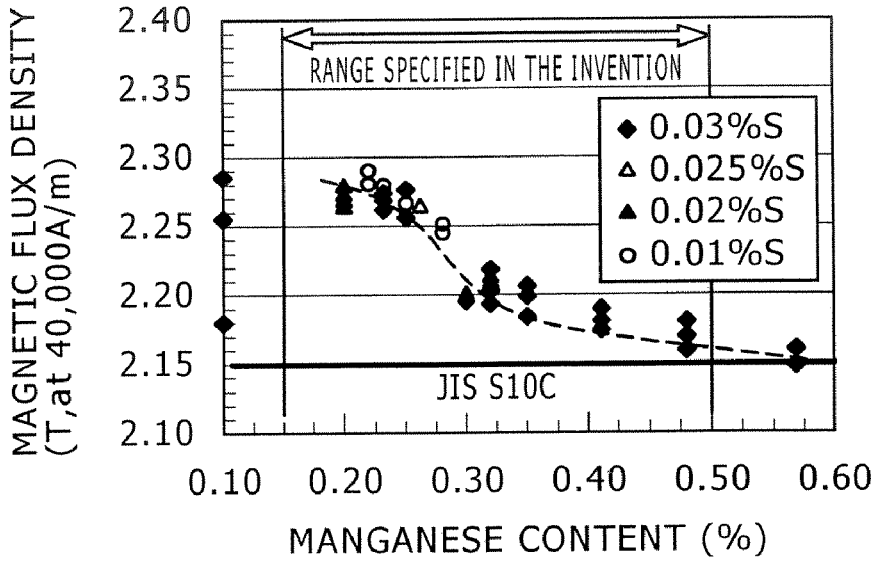
FIG. 6 is a graph showing the relationship among the Mn content, the S content, and the magnetic flux density.

In this connection, the present inventors made investigations on the chemical compositions of steels so as to form a structure showing reduced spontaneous magnetization, for exhibiting excellent magnetic properties regardless of the intensity of magnetic fields. FIG. 6 shows the relationship of the magnetic flux density in a magnetic field at 40,000 A/m with the Mn content and the S content in steels, as determined based on the data in the after-mentioned Examples. FIG. 6 shows that the Mn content must be reduced to 0.5 percent by mass or less regardless of the S content, so as to ensure a magnetic flux density stably at a level exceeding that of a regular low-carbon steel according to JIS S10C, namely, so as to ensure a magnetic flux density exceeding 2.15 T. The Mn content is preferably 0.3 percent by mass or less for further higher magnetic flux density of 2.2 T or more.

Sulfur (S) Content: 0.015 to 0.1 Percent by Mass

Figure 7:
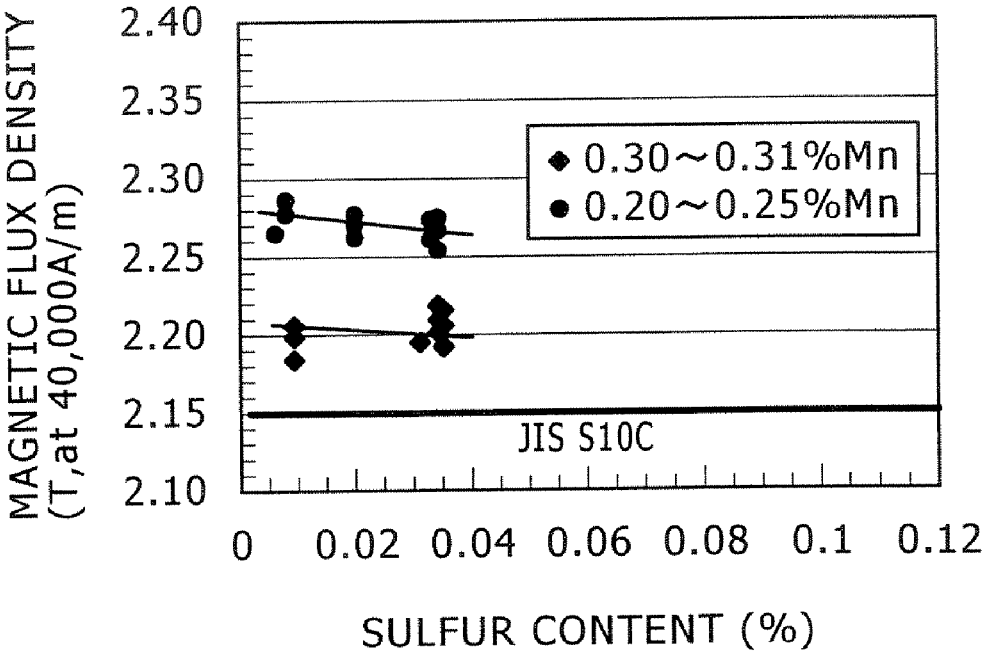
FIG. 7 is a graph showing the relationship among the S content, the Mn content, and the magnetic flux density.

The present inventors also made investigations on the relationship between the sulfur (S) content and the magnetic properties of steels, as in the Mn content. Specifically, the relationships of the Mn content and the S content with the magnetic flux density in a magnetic field of saturation region (40, 000 A/m) were investigated based on the data in after-mentioned Examples. They have found that the magnetic flux density gradually decreases with an increasing S content, as illustrated in FIG. 7. This effect of sulfur is less outstanding than that of manganese. The S content must be reduced to 0.1 percent by mass or less and preferably to 0.04 percent by mass or less regardless of the Mn content, so as to ensure a magnetic flux density stably at a level exceeding that of a regular low-carbon steel according to JIS S10C, namely, so as to ensure a magnetic flux density exceeding 2.15 T.

Figure 8:
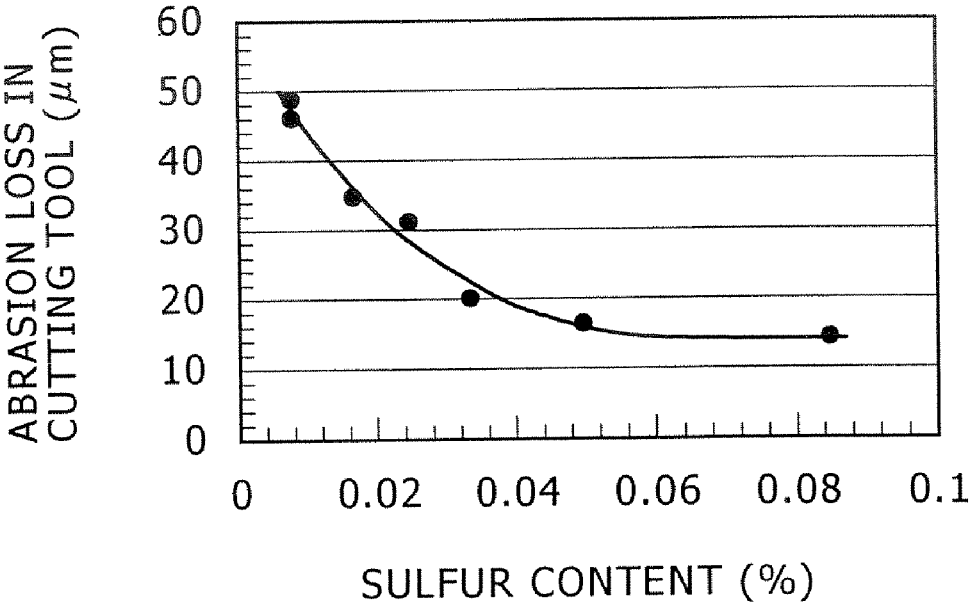
FIG. 8 is a graph showing the relationship between the S content and the abrasion loss in cutting tools.

In contrast, sulfur combines with Mn to produce MnS grains in steels, which ensure the machinability of steels. FIG. 8 is a graph showing the relationship between the S content and the cutting tool abrasion loss, as determined based on the data in after-mentioned Examples. FIG. 8 demonstrates that the S content must be 0.015 percent by mass or more and is preferably 0.02 percent by mass or more so as to sufficiently reduce the abrasion loss as compared with industrial pure iron having an abrasion loss of cutting tools of about 50 μm. FIG. 8 also demonstrates that the effect of improving machinability becomes saturated at a S content exceeding 0.1 percent by mass.

Silicon (Si) Content: 0.05 Percent by Mass or Less (Exclusive of 0 Percent by Mass)

Silicon (Si) functions as a deoxidizer when steels are melted. It also acts to increase the electrical resistance to thereby prevent the magnetic properties from decreasing due to eddy current. An excessive Si content may reduce the saturated magnetic flux density and impair the cold forgeability. For ensuring a satisfactory saturated magnetic flux density, the Si content is preferably 0.05 percent by mass or less and more preferably 0.01 percent by mass or less.

Aluminum (Al) Content: 0.01 Percent by Mass or Less (Exclusive of 0 Percent by Mass)

Aluminum (Al) fixes dissolved nitrogen in AlN, which reduces grain size. Excessive grain boundaries due to fine grain size may often impair the magnetic properties, and hence the aluminum content is preferably 0.01 percent by mass or less, and more preferably 0.005 percent by mass or less.

Phosphorus (P) Content: 0.02 Percent by Mass or Less (Exclusive of 0 Percent by Mass)

Phosphorus (P) contained in steels causes grain boundary segregation and adversely affects the cold forgeability and magnetic properties. Therefore, the phosphorus content should be controlled preferably to 0.02 percent by mass or less and more preferably to 0.01 percent by mass or less, for improved magnetic properties.

Nitrogen (N) Content: 0.01 Percent by Mass or Less (Exclusive of 0 Percent by Mass)

Nitrogen combines with Al to form AlN grains that affect adversely to magnetic properties. Nitrogen not combined with Al dissolves in the ferrite phase to form dissolved nitrogen, which adversely affects the magnetic properties of steels. The content of the dissolved nitrogen is effectively reduced by reducing the total nitrogen content in steels. Taking into consideration the practical condition of iron making processes, the nitrogen content is preferably 0.01 percent by mass or less and more preferably 0.005 percent by mass or less.

Oxygen (O) Content: 0.01 Percent by Mass or Less (Exclusive of 0 Percent by Mass)

Oxygen dissolves scarcely in steels at ordinary temperatures, and forms hard oxides having a significant effect of impairing the magnetic properties of steels. Therefore, the O content is preferably 0.01 percent by mass or less, more preferably 0.005 percent by mass or less, and further preferably 0.002 percent by mass or less.

At least one selected from the group consisting of:

Cupper (Cu) content: 0.02 to 0.2 percent by mass;

Nickel (Ni) content: 0.02 to 0.2 percent by mass; and

Chromium (Cr) content: 0.02 to 0.2 percent by mass

Copper, nickel and chromium effectively function to increase the electrical resistance of the ferrite phase and reduce the damping time constant of eddy current, and may be contained as additional elements in steels. For exhibiting these effects, each of the copper content, the nickel content, and the chromium content is preferably 0.02 percent by mass or more. However, excessive contents of these elements reduce the magnetic moment and impair the magnetic properties of steels. Each of these contents is therefore preferably 0.2 percent by mass or less and more preferably 0.1 percent by mass or less.

The elements specified in the present invention are as above, the remainder of steels comprises iron and inevitable impurities. The inevitable impurities can be elements contaminated from or derived from raw materials, manufacturing facilities and materials thereof. Arsenic (As) and other elements that do not adversely affect the objects of the present invention can also be contained in the steels and steel parts according to the present invention.

In manufacturing the soft magnetic steels according to the present invention, a steel billet of a chemical composition meeting the foregoing requirements may be melted and cast according to conventional melting and casting processes. However, to avoid manufacturing failures due typically to precipitated FeS grains, it is recommended to control the final temperature in continuous casting to 700° C. or lower and set the finishing rolling temperature in hot rolling at 900° C. or higher and preferably 950° C. or higher, as is described above. To effectively yield steels having excellent machinability and showing magnetic properties after magnetic annealing meeting requirements specified in JIS SUYB Class 1 or higher, the steels according to the present invention are preferably manufactured under the following conditions.

Heating Upon Hot Rolling

Heating temperature in hot rolling is preferably as high as possible to dissolve the alloying components of the steel completely in the matrix. However, excessively high temperatures cause coarse ferrite grains locally and reduces the cold forgeability during cold forging (forming work). Consequently, the steel is heated preferably at 1200° C. or lower and more preferably at 1150° C. or lower. In contrast, if the rolling temperature is excessively low, it is possible that MnS grains are not precipitated uniformly, different phases are produced locally and cracks develop in the steel sheet during rolling, and load on rolling rolls increases and productivity is reduced. The rolling temperature is therefore preferably 950° C. or higher.

Cooling Rate After Hot Rolling

Atomic vacancies increase when a steel is cooled at an excessively high cooling rate after hot rolling, and the steel is unable to undergo satisfactory recrystallization and to secure satisfactory magnetic properties even after undergoing magnetic annealing. The steel is thereby cooled at a cooling rate of preferably 10° C. or less per second, and more preferably 5° C. or less per second in the range of temperatures of 800° C. to 500° C. after hot rolling. An excessively low cooling rate will reduce productivity, and form large MnS grains, and hence the cooling rate is preferably 0.5° C. or more per second.

Magnetic Annealing Conditions

The soft magnetic steels and soft magnetic steel parts according to the present invention have magnetic properties meeting at least requirements specified in JIS SUYB Class 2 even without undergoing magnetic annealing. To manufacture soft magnetic steel parts having more excellent magnetic properties meeting requirements specified in JIS SUYB Class 1 or higher, it is very effective to carry out annealing of a formed steel part at a temperature of 850° C. or higher for two hours or longer.

Specifically, desired ferrite grains cannot be formed in a practical annealing time when the annealing temperature is lower than 850° C., and there by magnetic annealing is preferably conducted at a temperature of 850° C. or higher. The effect of yielding a desired grain size of ferrite grains becomes saturated at an excessively high annealing temperature, and the upper limit of the annealing temperature is set at 950° C.

Sufficiently large ferrite grains cannot be formed even if magnetic annealing is carried out at a high annealing temperature when the annealing time is shorter than 2 hours. Thus, it is desirable that the annealing temperature is 2 hours or longer, and more desirably, 3 hours or longer. In contrast, the annealing time is preferably 6 hours or shorter, because the effect of yielding sufficiently large ferrite grains becomes saturated when the annealing is conducted for an excessively long time.

Manufacturing conditions other than the above-specified conditions can be those generally employed. For example, the soft magnetic steel parts according to the present invention can be manufactured by melting and casting a steel having a chemical composition satisfying the above-specified requirements according to a conventional procedure, subjecting the cast to hot rolling under the above-specified conditions to form a rod or a wire, subjecting the rod or wire to forming work typically by cold or warm forging and machining, and subjecting the formed article to magnetic annealing under the above-specified conditions to thereby yield a magnetic part.

To manufacture an automobile solenoid or actuator as the soft magnetic steel part according to the present invention, for example, a wire is cut to a predetermined size and is subjected to forming work by cold working, a coil is wound around or inside the formed article, and the formed article is magnetized.

The present invention will be illustrated in further detail with reference to several examples and comparative examples below. It is to be noted that the followings are only examples which by no means limit the scope of the present invention, and various changes and modifications are possible therein without departing from the teaching and scope of the present invention.

EXAMPLES

Test steels (each 150 kg) having chemical compositions shown in Table 1 were sequentially subjected to vacuum ingot making, to hot forging at about 1100° C., and to hot rolling under conditions shown in Table 2 and thereby yielded bars having a diameter of 25 mm as test pieces. The sectional structure on metallographic structure and precipitates, the magnetic properties, cold forgeability, machinability, and formability of the test bars were determined by the following methods.

Metallographic Structure

Test bars were stuffed in a support, the exposed transverse sections of the bars were polished, and the polished surfaces of the test bars were immersed in a 5% alcohol solution of picric acid for 15 to 30 seconds for corroding. The sections of the test bars were observed by an optical microscope. The structures of a part at D/4, wherein D is the diameter of the test bar, of the sections of the test bars were magnified at a magnification of 100 times to 400 times, and ten photographs of ten fields of the section of each test bar were taken. The examination of the photographs revealed that all the test bars have a single-phase ferrite microstructure as the metallographic structure. Test pieces were subjected to magnetic annealing under the following conditions, and the average grain size of the ferrite in the annealed test pieces was determined. As a result, all the test pieces were found to have an average grain size of ferrite of 100 μm or more.

Major Axis and Density of Precipitated FeS Grains

The sections of the test pieces were observed under a scanning electron microscope (SEM) at a magnification of 4000 times, and ten photographs of ten fields of the section of each test piece were taken. The major axes and densities of the test pieces were determined using an image analyzer as averages of the ten fields. The densities (numbers) of precipitated MnS grains having a major axis exceeding 5 μm and of precipitated MnS grains having a major axis of 0.5 to 5 μm per 10000 $\mu m^2$ in sections in a rolling direction of the steels were determined by a scanning electron microscopic observation at a magnification of 2400 times and using an image analyzer in the same manner as above.

Magnetic Properties

Columnar test pieces having a diameter of 7 mm and a height of 7 mm were prepared from the test steels and were subjected to magnetic annealing at 850° C. for 3 hours. A coil for applying a magnetic field and another coil for detecting magnetic flux were wound around the test pieces, and the magnetic flux densities of the test pieces were determined by measuring and plotting H-B curves using an automatic magnetization measuring device [the direct-current magnetization measuring device BHH-25CD, a product of Riken Denshi Co., Ltd.]. The magnetic annealing was carried out at sweep rates of external magnetic field of 3000 A/m/sec and 30000 A/m/sec, respectively, and the magnetic flux densities of the test pieces at a magnetic field intensity of 40000 A/m were determined in a magnetization process in which the highest magnetic field was 1000000 A/m. This was conducted for determining properties under conditions of high change rate of magnetic field, as assumed in parts for use in high-intensity magnetic fields. Five test pieces per one test steel were subjected to the above measurement (n=5), and the average and variation (difference between the maximum value and the minimum value) of measured magnetic flux densities were determined.

Coercive Force

Test rings having an outer diameter of 24 mm, an inner diameter of 16 mm, and a height of 4 mm were prepared and were subjected to magnetic annealing at 850° C. for 3 hours. A coil for applying a magnetic field and another coil for detecting magnetic flux were wound around the test rings, and the coercive forces of the test rings were determined by the procedure as in the magnetic flux density. Five test pieces per one test steel were subjected to the above measurement (n=5), and the average and variation (difference between the maximum value and the minimum value) of measured values were determined.

Cold Forgeability

The cold forgeabilities of test steels were determined by measuring critical upset ratios to crack initiation as an index. The critical upset ratios to crack initiation were measured according to the method described in Kobe Steel Engineering Reports Research and Development (R&D), Vol. 23, No. 2, p. 90-96. Specifically, test columns were notched with a radius of notched grooves of 0.05 mm, were subjected to confined compression using a compressing disc having concentric grooves, and maximum upset ratios before cracking initiation were determined.

Machinability

The test steel bars having a diameter of 25 mm were subjected to wet machining using a cemented carbide tool at a circumferential speed of 260 m/min., a feed of 0.18 mm per revolution, and a cutting depth of 0.2 mm for 5 minutes. The machinability of the test bars was determined by measuring the flank wear of the tool.

Formability

Figure 9:
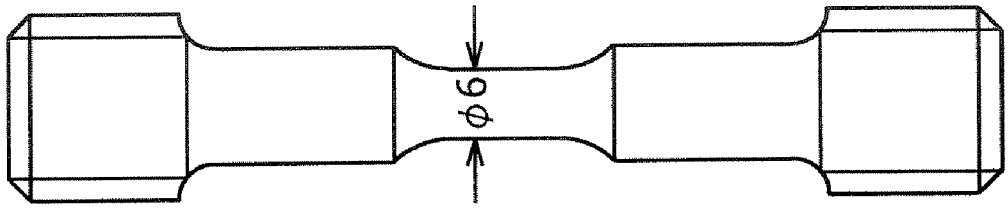
FIG. 9 is a side view of a test piece for a hot tensile test.
Figure 10:
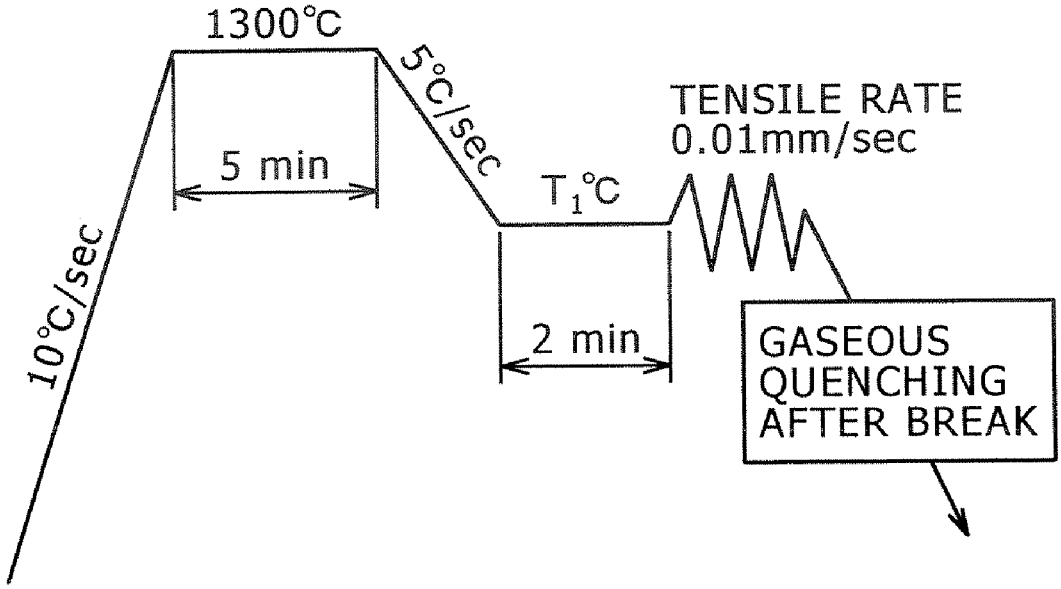
FIG. 10 is a view of a heating pattern in a hot tensile test.

The formabilities of test steels were determined by carrying out hot tensile tests. The formability herein means such a property that cracking and other problems do not occur during continuous casting, blooming, and hot rolling processes. As the hot tensile test, a tensile test in the heating pattern shown in FIG. 10 was conducted using the test piece shown in FIG. 9. The tests were conducted at different four T1s in FIG. 10 of 800° C., 900° C., 1000° C., and 1100° C., and the reductions of area were measured. The lowest reduction of area among the measured reductions of area was used as an index. Specially, a test piece showing the lowest reduction of area of 20% or more was evaluated as having excellent formability without, for example, cracking during continuous casting, blooming, and hot rolling processes.

The results of these determinations are also shown in Table 2. The criteria for the determinations in Table 2 are shown in Table 3.

TABLE 1

| | Chemical Composition* (mass %) | | | | | | | | | | | | |
|---|---|---|---|---|---|---|---|---|---|---|---|---|---|
| Steel No. | C | Si | Mn | P | S | Cu | Ni | Cr | Al | N | O | Mn/S | Mn/S + 56.8 C |
| 1 | 0.005 | 0.008 | 0.20 | 0.007 | 0.020 | 0.01 | 0.01 | 0.02 | 0.006 | 0.0034 | 0.0045 | 10.0 | 10.3 |
| 2 | 0.007 | 0.002 | 0.31 | 0.011 | 0.015 | tr | tr | tr | 0.006 | 0.0033 | 0.0056 | 20.7 | 21.1 |
| 3 | 0.008 | 0.030 | 0.32 | 0.012 | 0.035 | 0.03 | 0..02 | 0.03 | 0.008 | 0.0032 | 0.0041 | 9.1 | 9.6 |
| 4 | 0.008 | 0.030 | 0.32 | 0.011 | 0.034 | 0.10 | 0.10 | 0.09 | 0.008 | 0.0024 | 0.0040 | 9.4 | 9.9 |
| 5 | 0.007 | 0.007 | 0.41 | 0.007 | 0.030 | 0.01 | 0.03 | 0.01 | 0.004 | 0.0022 | 0.0020 | 13.7 | 14.1 |
| 6 | 0.005 | 0.008 | 0.48 | 0.006 | 0.030 | 0.02 | 0.01 | 0.01 | 0.006 | 0.0031 | 0.0035 | 16.0 | 16.3 |
| 7 | 0.004 | 0.008 | 0.25 | 0.005 | 0.080 | 0.01 | 0.01 | 0.01 | 0.007 | 0.0021 | 0.0051 | 3.1 | 3.4 |
| 8 | 0.035 | 0.006 | 0.25 | 0.007 | 0.021 | 0.01 | 0.01 | 0.02 | 0.005 | 0.0018 | 0.0059 | 11.9 | 13.9 |
| 9 | 0.100 | 0.006 | 0.20 | 0.007 | 0.040 | 0.01 | 0.01 | 0.02 | 0.005 | 0.0018 | 0.0059 | 5.0 | 10.7 |
| 10 | 0.008 | 0.230 | 0.22 | 0.008 | 0.022 | 0.01 | 0.01 | 0.02 | 0.004 | 0.0028 | 0.0024 | 10.0 | 10.5 |
| 11 | 0.005 | 0.004 | 0.10 | 0.010 | 0.030 | tr | tr | tr | 0.003 | 0.0030 | 0.0064 | 3.3 | 3.6 |
| 12 | 0.006 | 0.004 | 0.57 | 0.008 | 0.031 | 0.01 | 0.01 | 0.01 | 0.006 | 0.0019 | 0.0028 | 18.4 | 18.7 |
| 13 | 0.008 | 0.008 | 0.21 | 0.025 | 0.026 | 0.01 | 0.02 | 0.01 | 0.005 | 0.0024 | 0.0057 | 8.1 | 8.5 |
| 14 | 0.004 | 0.004 | 0.23 | 0.009 | 0.008 | 0.01 | 0.02 | 0.03 | 0.004 | 0.0030 | 0.0064 | 28.8 | 29.0 |
| 15 | 0.005 | 0.004 | 0.26 | 0.010 | 0.240 | 0.01 | 0.01 | 0.01 | 0.004 | 0.0007 | 0.0068 | 1.1 | 1.4 |
| 16 | 0.008 | 0.007 | 0.22 | 0.011 | 0.028 | 0.28 | tr | tr | 0.006 | 0.0017 | 0.0055 | 7.9 | 8.3 |
| 17 | 0.006 | 0.008 | 0.23 | 0.008 | 0.027 | tr | 0.28 | tr | 0.004 | 0.0026 | 0.0053 | 8.5 | 8.9 |
| 18 | 0.004 | 0.006 | 0.22 | 0.007 | 0.031 | tr | tr | 0.27 | 0.004 | 0.0024 | 0.0066 | 7.1 | 7.3 |
| 19 | 0.004 | 0.007 | 0.25 | 0.009 | 0.034 | 0.02 | 0.01 | 0.01 | 0.022 | 0.0033 | 0.0064 | 7.4 | 7.6 |
| 20 | 0.005 | 0.070 | 0.24 | 0.004 | 0.020 | 0.01 | 0.01 | 0.01 | 0.004 | 0.0033 | 0.0015 | 12.0 | 12.3 |
| 21 | 0.006 | 0.004 | 0.21 | 0.008 | 0.020 | 0.01 | 0.01 | 0.01 | 0.004 | 0.0033 | 0.0120 | 10.5 | 10.8 |

*The remainder comprises iron and inevitable impurities

TABLE 2

| | | Production condition | | | Density of FeS grains | Density of MnS grains | |
|---|---|---|---|---|---|---|---|
| | | | Finishing | | with major | | |
| Sample No. | Steel No. | Heating Temperature ° C. | Rolling Temperature ° C. | Cooling rate ° C./sec | axis of 0.1 μm or more grains/mm$^2$ | Major axis of 0.5-5 μm grains/10000 μm2 | Major axis exceeding 5 μm grains/10000 μm2 |
| 1 | 1 | 1072 | 985 | 1.2 | 1323 | 38 | 1 |
| 2 | 2 | 1056 | 965 | 1.3 | 106 | 37 | 1 |
| 3 | 3 | 1075 | 979 | 1.3 | 2624 | 47 | 2 |
| 4 | 3 | 975 | 850 | 1.4 | 5122 | 29 | 6 |
| 5 | 4 | 1082 | 982 | 1.2 | 1958 | 58 | 2 |
| 6 | 5 | 1074 | 985 | 1.4 | 1693 | 64 | 1 |
| 7 | 6 | 1078 | 987 | 1.6 | 534 | 49 | 1 |
| 8 | 7 | 1085 | 989 | 1.3 | 16085 | 64 | 4 |
| 9 | 8 | 1074 | 979 | 1.4 | 899 | 45 | 1 |

TABLE 2-continued

| | | | | | | | |
|---|---|---|---|---|---|---|---|
| 10 | 9 | 1079 | 974 | 1.3 | 7932 | 41 | 1 |
| 11 | 10 | 1084 | 984 | 1.5 | 204 | 25 | 2 |
| 12 | 11 | 1088 | 985 | 1.2 | 16076 | 41 | 1 |
| 13 | 12 | 1064 | 968 | 1.3 | 212 | 52 | 1 |
| 14 | 13 | 1097 | 995 | 1.5 | 2116 | 51 | 2 |
| 15 | 14 | 1085 | 986 | 1.4 | 53 | 14 | 1 |
| 16 | 15 | 1089 | 992 | 1.2 | 20614 | 87 | 8 |
| 17 | 16 | 1076 | 976 | 1.2 | 2116 | 53 | 1 |
| 18 | 17 | 1085 | 990 | 1.3 | 2063 | 46 | 2 |
| 19 | 18 | 1087 | 994 | 1.2 | 2487 | 54 | 1 |
| 20 | 19 | 1094 | 990 | 1.3 | 1270 | 48 | 2 |
| 21 | 20 | 1089 | 992 | 1.4 | 252 | 34 | 1 |
| 22 | 21 | 1090 | 997 | 1.4 | 2381 | 63 | 2 |

| | Coercive Force | | Magnetic Flux | | Critical upset ratio to crack | Flank | Reduction of area in hot |
|---|---|---|---|---|---|---|---|
| Sample No. | Average A/m | MAX-MIN A/m | Average T | MAX-MIN T | initiation % | wear μm | tensile test % |
| 1 | 46.8 | 6.7 | 2.361 | 0.015 | 80 or more | 32.4 | 99.6 |
| 2 | 43.3 | 6.6 | 2.263 | 0.010 | 80 or more | 34.5 | 99.8 |
| 3 | 45.1 | 6.0 | 2.258 | 0.014 | 80 or more | 21.2 | 99.1 |
| 4 | 52.6 | 10.4 | 2.291 | 0.045 | 80 or more | 38.8 | 64.2 |
| 5 | 51.9 | 6.4 | 2.258 | 0.014 | 80 or more | 21.6 | 99.2 |
| 6 | 54.7 | 6.3 | 2.230 | 0.014 | 80 or more | 23.7 | 99.4 |
| 7 | 57.2 | 6.6 | 2.361 | 0.018 | 80 or more | 21.4 | 99.0 |
| 8 | 64.0 | 8.0 | 2.306 | 0.107 | 50 | 13.8 | 13.2 |
| 9 | 71.7 | 6.2 | 2.115 | 0.013 | 65 | 31.3 | 99.3 |
| 10 | 62.4 | 11.2 | 2.254 | 0.102 | 55 | 20.2 | 14.8 |
| 11 | 44.0 | 5.8 | 2.389 | 0.010 | 80 or more | 52.4 | 87.0 |
| 12 | 67.3 | 15.2 | 2.292 | 0.106 | 45 | 24.0 | 8.8 |
| 13 | 51.7 | 6.1 | 2.154 | 0.010 | 80 or more | 23.6 | 99.7 |
| 14 | 76.4 | 5.8 | 2.248 | 0.017 | 80 or more | 27.4 | 98.9 |
| 15 | 41.4 | 6.1 | 2.325 | 0.007 | 80 or more | 47.0 | 99.7 |
| 16 | 87.0 | 12.0 | 2.197 | 0.124 | 20 | 12.6 | 6.5 |
| 17 | 74.2 | 6.3 | 2.196 | 0.017 | 80 or more | 25.9 | 98.9 |
| 18 | 67.7 | 6.4 | 2.129 | 0.016 | 80 or more | 26.2 | 99.2 |
| 19 | 67.2 | 5.9 | 2.174 | 0.016 | 80 or more | 23.6 | 99.4 |
| 20 | 43.5 | 6.6 | 2.170 | 0.014 | 80 or more | 30.5 | 99.0 |
| 21 | 45.3 | 5.4 | 2.372 | 0.012 | 80 or more | 44.4 | 93.4 |
| 22 | 65.4 | 6.6 | 2.297 | 0.087 | 80 or more | 78.0 | 99.5 |

TABLE 3

| Properties | Measured items | | ○ | X |
|---|---|---|---|---|
| Magnetic properties | Coercive force | Average | 60 A/m or more | At least one of the items does not satisfy the requirement |
| | | Variation (Max-Min) | 10 A/m or less | |
| | Magnetic flux density | Average | 2.15 T or more | |
| | | Variation (Max-Min) | 0.1 T or less | |
| Cold forgeability | Critical upset ratio to crack initiation | | 80% or more | less than 80% |
| Machinability | Flank wear | | 40 μm or less | more than 40 μm |
| Formability | Reduction of area in hot tensile test | | 20% or more | less than 20% |

Tables 1 to 3 demonstrate as follows. The "Sample number" hereinbelow refers to "Sample No." in Table 2.

Samples Nos. 1 to 3, and 5 to 7 have chemical compositions satisfying the requirements specified in the present invention and contain, if any, precipitated FeS grains within the range specified in the present invention. They are therefore excellent in cold forgeability, machinability, and formability and exhibit magnetic properties after annealing meeting requirements specified in JIS SUYB Class 1 or higher without variation.

In contrast, Samples Nos. 4 and 8 to 22 have chemical compositions or have excessively precipitated FeS grains and do not satisfy the requirements specified in the present invention. Accordingly, they have a low critical upset ratio to crack initiation and exhibit poor cold forgeability; have a large abrasion loss of cutting tool and exhibit poor machinability; or fail to have stable magnetic properties meeting requirements specified in JIS SUYB Class 1 even after annealing.

Specifically, although having a chemical composition satisfying the requirements specified in the present invention, Sample No. 4 contains a large number of precipitated FeS grains due to the low finishing rolling temperature in the production process and is poor in magnetic properties and cold forgeability. Sample No. 8 has a low mass ratio of Mn to S (Mn/S), contains a large number of precipitated FeS grains, and is poor in magnetic properties and formability. This sample has a value (Mn/S+56.8C) out of the preferred range in the present invention, thereby has a low reduction of area in the hot tensile test, is poor in formability, and is susceptible to cracking during cold forging. Sample No. 9 has an excessive C content and is poor in magnetic properties and cold forgeability. Sample No. 10 has an excessive C content and a low mass ratio of Mn to S(Mn/S) and is poor in magnetic properties, cold forgeability, and formability.

Samples Nos. 11 and 21 have excessive Si contents and are poor in machinability.

Sample No. 12 has a low Mn content and a low mass ratio of Mn to S (Mn/S), thereby contains a large number of precipitated FeS grains, and is poor in magnetic properties and formability. This sample has a value (Mn/S+S6.8C) out of the preferred range in the present invention, is poor in formability, and is susceptible to cracking during cold forging. Sample No. 13 has an excessive Mn content and is poor in magnetic properties.

Sample No. 14 has an excessive P content and is poor in magnetic properties and cold forgeability. Sample No. 15 has a low S content and is poor in machinability. Sample No. 16 has an excessive S content, thereby contains large amounts of precipitated FeS and MnS grains, and is poor in magnetic properties, cold forgeability, and formability. This sample has a value (Mn/S+56.8C) out of the preferred range in the present invention, is poor in formability, and is susceptible to cracking during cold forging.

The results of Samples Nos. 17 to 19 show that Cu, Ni, and/or Cr, if added, should be preferably added in amounts within the above-specified ranges so as to avoid adverse effects on the magnetic properties.

Sample No. 20 has an excessive Al content and is poor in magnetic properties. Sample No. 22 has an excessive oxygen content and is poor in magnetic properties, cold forgeability, and machinability.

Figure 11:
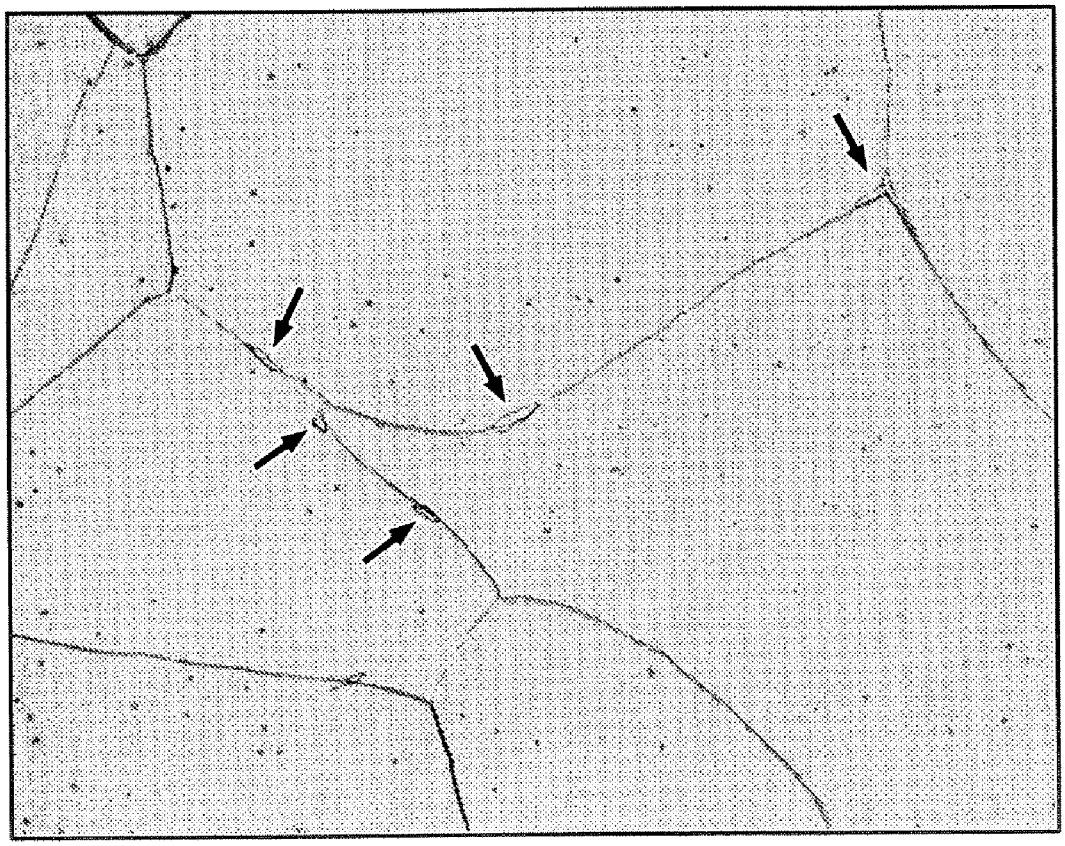
FIG. 11 is a scanning electron micrograph of the microstructure of a comparative steel.

A scanning electron micrograph of the structure of a comparative steel in the section in a rolling direction is shown in FIG. 11 at a magnification of 4000 times for reference. FIG. 11 shows that the comparative steel contains a large number of precipitated FeS grains, which cause significant variations in magnetic properties.

What is claimed is:

1. A soft magnetic steel having a composition satisfying:

a carbon (C) content of 0.0015 to 0.02 percent by mass;

a manganese (Mn) content of 0.15 to 0.5 percent by mass; and a sulfur (S) content of 0.015 to 0.1 percent by mass, wherein the steel has a mass ratio of Mn to S (Mn/S) of 5.7 or more, wherein the steel comprises a single-phase ferrite microstructure as its metallographic structure, and wherein the density of precipitated FeS grains having a major axis of 0.1 μm or more is 5000 grains or less per square millimeter of the steel.

2. The soft magnetic steel according to claim 1, wherein the density of precipitated MnS grains having a major axis exceeding 5 μm is 5 grains or less and the number of precipitated MnS grains having a major axis of 0.5 to 5 μm is 20 to 80 grains, each per 1000 square micrometers of a section in a rolling direction of the steel.

3. The soft magnetic steel according to claim 1, having a composition further satisfying:

a silicon (Si) content of 0.05 percent by mass or less (exclusive of 0 percent by mass);

an aluminum (Al) content of 0.01 percent by mass or less (exclusive of 0 percent by mass);

a phosphorus (P)content of 0.02 percent by mass or less (exclusive of 0 percent by mass);

a nitrogen (N) content of 0.01 percent by mass or less (exclusive of 0 percent by mass); and an oxygen (O) content of 0.01 percent by mass or less (exclusive of 0 percent by mass).

4. The soft magnetic steel according to claim 3, having a composition further satisfying at least one selected from the group consisting of:

a copper (Cu) content of 0.02 to 0.2 percent by mass;

a nickel (Ni) content of 0.02 to 0.2 percent by mass; and a chromium (Cr) content of 0.02 to 0.2 percent by mass.

5. The soft magnetic steel according to claim 1, satisfying the following Condition (1):

$$Mn/S+56.8C \geqq 5.3 \quad (1)$$

wherein "Mn", "S", and "C" represent the contents (percent by mass) of manganese, sulfur, and carbon, respectively.

6. A soft magnetic steel part made from the steel according to claim 1, wherein the part has a single-phase ferrite microstructure having an average grain size of 100 μm or more as its metallographic structure.

* * * * *